US009656216B2

(12) United States Patent
Hardesty et al.

(10) Patent No.: US 9,656,216 B2
(45) Date of Patent: May 23, 2017

(54) SCALABLE PARALLEL MIXING SYSTEM AND METHOD

(71) Applicant: The Marley-Wylain Company, Michigan City, IN (US)

(72) Inventors: Ryan Hardesty, Valparaiso, IN (US); Aaron Smith, Laporte, IN (US); Neil Butt, New Carlisle, IN (US)

(73) Assignee: THE MARLEY-WYLAIN COMPANY, Michigan City, IN (US)

( * ) Notice: Subject to any disclaimer, the term of this patent is extended or adjusted under 35 U.S.C. 154(b) by 120 days.

(21) Appl. No.: 14/660,590

(22) Filed: Mar. 17, 2015

(65) Prior Publication Data

US 2015/0267646 A1 Sep. 24, 2015

Related U.S. Application Data

(60) Provisional application No. 61/955,438, filed on Mar. 19, 2014.

(51) Int. Cl.

| | |
|---|---|
| ***B01F 3/04*** | (2006.01) |
| ***B01F 5/04*** | (2006.01) |
| ***F02M 19/10*** | (2006.01) |
| ***F02M 19/08*** | (2006.01) |

(52) U.S. Cl.

CPC ..... *B01F 3/0446* (2013.01); *B01F 3/04007* (2013.01); *B01F 5/04* (2013.01); *B01F 5/0413* (2013.01); *B01F 5/0418* (2013.01); *B01F 5/0421* (2013.01); *F02M 19/081* (2013.01); *F02M 19/10* (2013.01); *B01F 2005/0435* (2013.01); *Y10T 29/49398* (2015.01)

(58) Field of Classification Search

CPC .... B01F 3/04; B01F 3/04007; B01F 3/04021; B01F 5/04; B01F 5/0413; B01F 5/0418; B01F 5/0421; B01F 5/0428; F02M 19/08; F02M 19/10; F02M 19/081

USPC ..... 261/78.1, DIG. 12

See application file for complete search history.

(56) References Cited

U.S. PATENT DOCUMENTS 3,549,132 A * 12/1970 Haase ..... F02M 1/00 261/23.2

4,229,385 A * 10/1980 Leibfreid ..... F02M 9/103 261/44.9

* cited by examiner

*Primary Examiner* — Robert A Hopkins

(74) *Attorney, Agent, or Firm* — Baker & Hostetler LLP

(57) ABSTRACT

A mixing manifold is provided. The manifold includes: a body; a first converging passageway in the body; a first diverging passageway in the body in-line and in fluid communication with the first converging passageway to form a first venturi; a first obstruction in a throat of the first venturi configured to move between two positions, a blocking position that blocks, at least in part, flow through the first venturi and an open position; a second converging passageway in the body; a second diverging passageway in the body in-line and in fluid communication with the second converging passageway to form a second venturi; and a second obstruction in the second venturi configured to move between two positions, a blocking position that blocks, at least in part, flow through the second venturi and an open position. A method of providing fluid flow through a manifold is also provided.

20 Claims, 4 Drawing Sheets

SCALABLE PARALLEL MIXING SYSTEM AND METHOD

CROSS-REFERENCE TO RELATED APPLICATIONS

This application claims priority to U.S. Provisional Application No. 61/955,438, filed Mar. 19, 2014, the disclosure of which is incorporated herein by reference in its entirety.

FIELD OF THE INVENTION

The present disclosure relates generally to a mixing system and method for controlling an amount of air that flows through a manifold. More particularly, the present disclosure relates to a manifold that has at least two venturis that can be at least partially blocked to control an amount of fluid that flows through the manifold.

BACKGROUND OF THE INVENTION

Many combustion systems mix fuel and air prior to the fuel air mixture being provided to the combustion chamber. Many of these premixed combustion systems use a venturi device to regulate the air fuel ratio. The basic principle is that air for combustion is pulled (or pushed) through a venturi-shaped pathway. The venturi pathway reduces the cross-sectional area at the venturi throat which causes an increase of flow velocity thus reducing pressure. It is this low pressure which induces fuel flow from a fuel source which is at a higher pressure than the low pressure found at the venturi throat into the air stream from a separate port. This pneumatic coupling is useful since these combustion systems can maintain an air fuel ratio even when the airflow changes whether intentionally or accidentally.

Reducing the airflow from its maximum and through its minimum, and vice versa, is often done with a variable speed blower. This adjustment allows the system to operate at different input rates. The ratio between the maximum flow and the minimum flow is referred to as a turndown ratio. These systems often only work within a certain operating range because as the venturi throat becomes oversized at lower flow rates and does not increase the velocity enough to lower pressure sufficiently to properly induce required fuel flow.

Accordingly, it is desirable to provide a system and method which allows an apparatus to operate with broader operating parameters. In other words, a system and method may operate along a broader turndown ratio.

SUMMARY OF THE INVENTION

The foregoing needs are met to a great extent by the present invention, wherein, in some embodiments allows a system and/or a method to operate with broader operating parameters. In other words, a system and method may operate along a broader turndown ratio.

In accordance with one embodiment of the present invention, a mixing manifold is provided. The manifold includes: a body; a first converging passageway in the body; a first diverging passageway in the body in-line and in fluid communication with the first converging passageway to form a first venturi; a first obstruction in a throat of the first venturi configured to move between two positions, a blocking position that blocks, at least in part, flow through the first venturi and an open position; a second converging passageway in the body; a second diverging passageway in the body in-line and in fluid communication with the second converging passageway to form a second venturi; and a second obstruction in the second venturi configured to move between two positions, a blocking position that blocks, at least in part, flow through the second venturi and an open position.

In accordance with another embodiment of the present invention, a method of providing fluid flow through a manifold is provided. The method includes: providing multiple venturi passageways in a body; installing an obstruction in a throat of the venturi passageways; configuring the obstruction to move between a blocking position and an open position.

In accordance with yet another embodiment of the present invention, a mixing manifold is provided. The manifold includes: a body; a first converging passageway in the body; a first diverging passageway in the body in-line and in fluid communication with the first converging passageway to form a first venturi; a first means for obstructing located in a throat in the first venturi configured to move between two positions, a blocking position that blocks, at least in part, flow through the first venturi and an open position; a second converging passageway in the body; a second diverging passageway in the body in-line and in fluid communication with the second converging passageway to form a second venturi; and a second means for obstructing in the second venturi configured to move between two positions, a blocking position that blocks, at least in part, flow through the second venturi and an open position.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
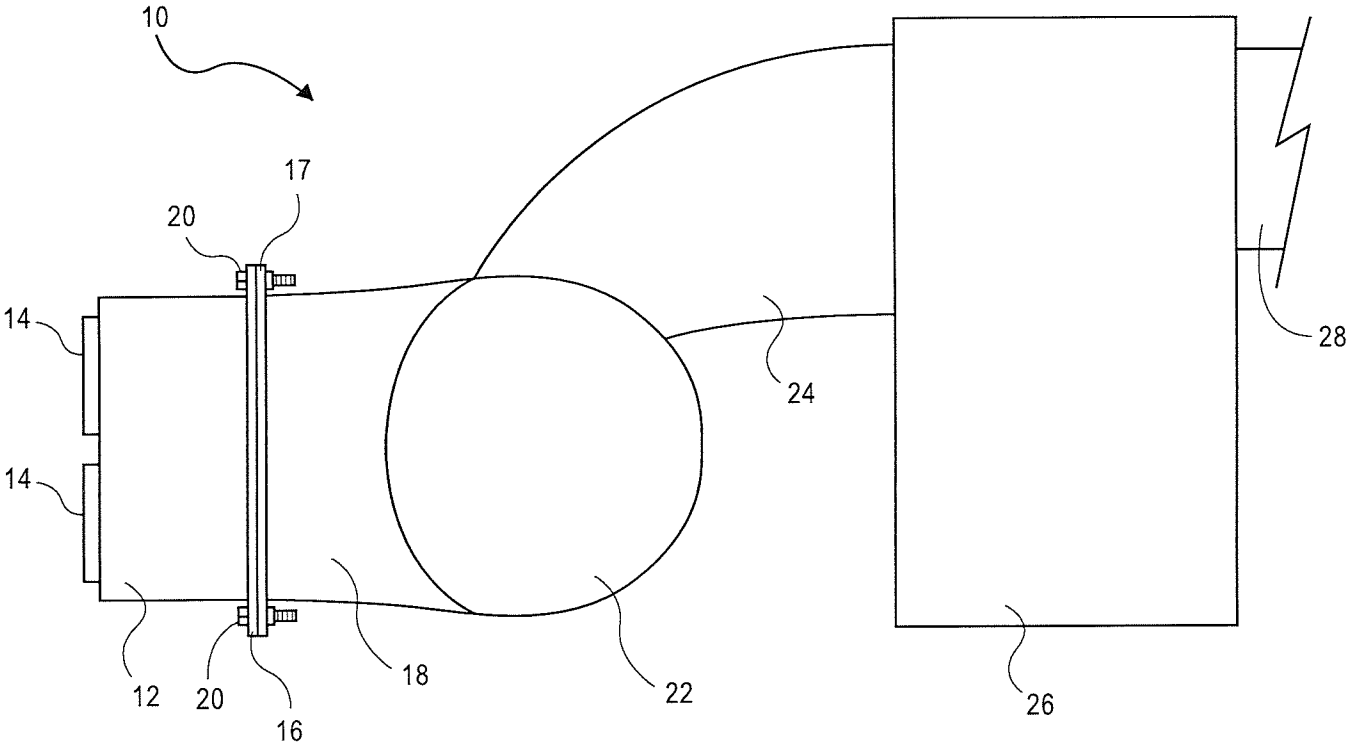
FIG. 1 is a side view illustrating an air-fuel mixing and combustion system according to an embodiment in accordance with this disclosure.

The invention will now be described with reference to the drawing figures, in which like reference numerals refer to like parts throughout. An embodiment in accordance with the present disclosure provides a method and apparatus that allows the amount of air that flows into the manifold to be scaled up or down. A manifold having a plurality of inlets can allow air coming into the inlet to flow through all or some of the inlets and the adjustment, opening, or closing of a throttling valve in the inlets is accomplished by the airflow itself.

An embodiment of the present inventive apparatus is illustrated in FIG. 1. FIG. 1 illustrates a combustion system 10. The combustion system 10 includes a venturi manifold 12. The venturi manifold 12 includes intake cowlings 14. The venturi manifold 12 is connected by a manifold flange 16 to a conduit flange 17. The connection between the manifold flange 16 and the conduit flange 17 connects the venturi manifold 12 to a conduit 18. The manifold flange 16 and conduit flange 17 may be connected via bolts 20 and nuts 21. In other embodiments, the manifold flange 16 may be connected to the conduit 18 in any suitable manner which may or may not include bolts 20 and nuts 21 or flanges 16 and 17.

The conduit 18 connects the intake manifold 12 to a blower 22. The blower 22 is connected to a conduit 24 which provides a fluid connection between the blower 22 and the combustion device 26. A conduit 28 is connected to the combustion device 26 to provide a fluid connection to an exhaust system for exhausting combustion products out of the combustion device 26.

The combustion device 26 may be any household or commercial combustion device 26. Examples may include, but are not limited to, boilers, furnaces, hot water heaters, gas dryers or any other type of combustion device. In the system 10 shown in FIG. 1, air is drawn through the intake cowlings 14 into the manifold 12. As will be described and illustrated in more detail later with respect to other figures, fuel may be mixed with the air in the manifold 12. The air/fuel mixture moves through the conduit 18 into the blower 22 due to the suction or pulling action of the blower 22.

The air/fuel mixture moves through the conduit 24 into the combustion device 26. The air fuel mixture is burned within the combustion device 26, creating heat. The combustion products or exhaust is vented out the conduit 28 into an exhaust system and may be vented outside or wherever exhaust is desired to be vented.

While the system shown in FIG. 1 is an example, it will be appreciated by one of ordinary skill in the art that various components of the system 10 may be moved. For example, the blower 22 may blow air rather than pull air through the manifold 12. In such systems, the manifold 12 may be located between the blower 22 and the combustion device 26. The various conduits 18, 24, and 28 may be modified, absent, or added to as needed for a particular system or installation. One of ordinary skill in the art, after reviewing this disclosure, will understand how to modify and arrange the various components of a combustion system 10 in order to achieve desired results.

The manifold 12 may add fuel to the air using a venturi system. As described above, various systems 10 may have turndown ratios which may result in relatively low airflow through the manifold 12. If the airflow through the manifold 12 becomes too low, then a venturi system will have difficulty adding an appropriate amount of fuel. As a result, the present disclosure is directed to modify a manifold 12 to have various parallel venturis in order to scale up or down according to an airflow need an amount of venturis in order to provide a desired amount of air and fuel to the combustion system 10.

Figure 2:
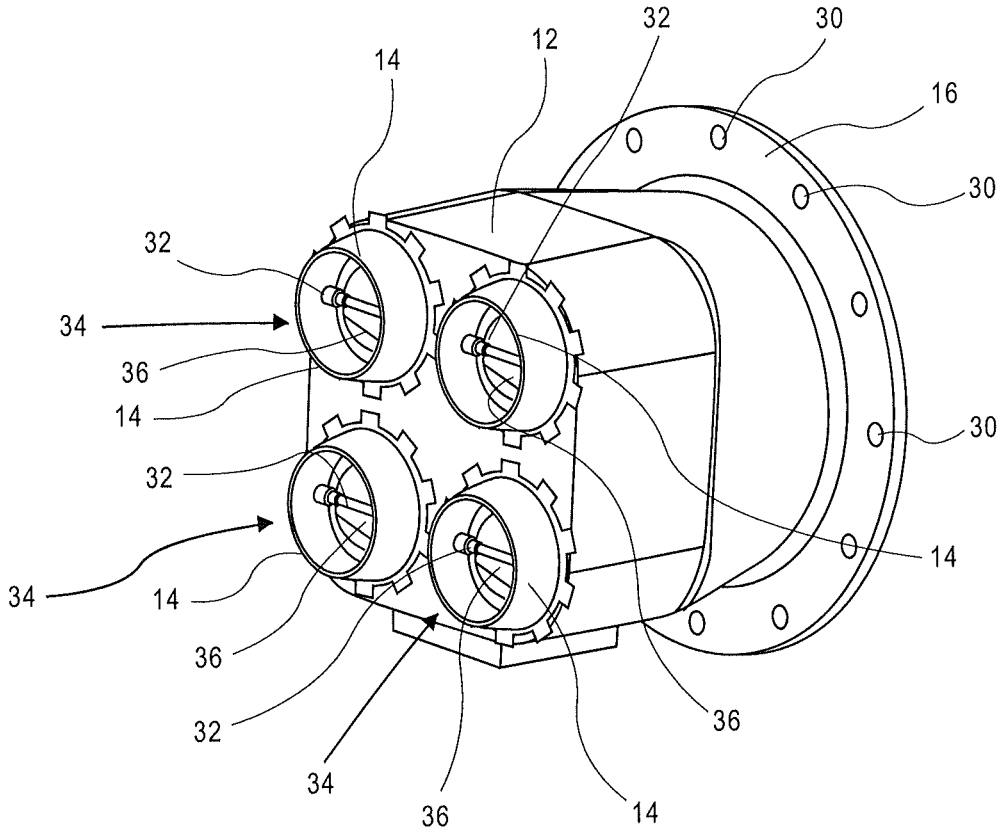
FIG. 2 is a perspective view of a manifold according to an embodiment of the disclosure.

FIG. 2 is a perspective view of a manifold 12 in accordance with an embodiment of the present disclosure. The manifold 12 includes intake cowlings 14. The manifold 12 is also equipped with a manifold flange 16 having bolt holes 30 which allow the bolts 20 as shown in FIG. 1 to attach the manifold 12 to a conduit 18 as previously shown and described.

Pivot shafts 32 are located in the manifold 12. In some embodiments, and as shown, the air intakes 34 are surrounded by intake cowlings 14. The intake cowlings 14 are optional and may not be present in all embodiments. The pivot shaft 32 supports and allows a flap 36 to move between an open and closed position within the air intakes 34.

Figure 3:
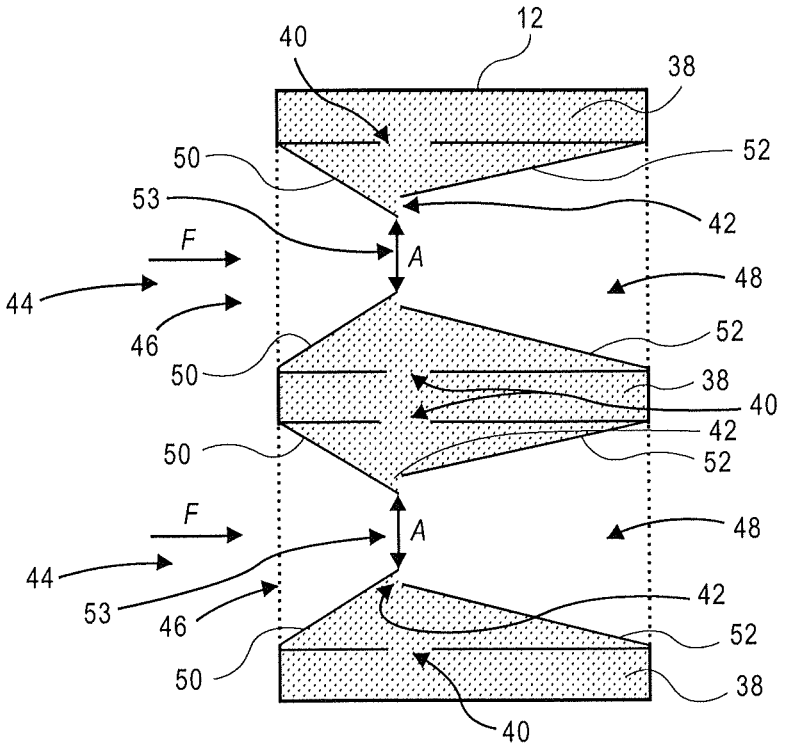
FIG. 3 is a partial cross-sectional view of a manifold showing the venturi passageways.

FIG. 3 is a partial cross-sectional view of a venturi manifold 12 in accordance with the present disclosure. Fuel supplies 38 are equipped with fuel supply gaps 40 allow fuel coming from a fuel reservoir to flow through the fuel supply 38 through the fuel supply gap 40 into the fuel inlet 42. In some embodiments, the fuel inlet 42 is located within the venturi 44 to allow fuel to mix with air flowing through the venturi 44. In the embodiment shown herein, the venturi manifold 12 has at least two venturis 44.

The venturi 44 consists of a converging nozzle 46 and a diverging nozzle 48. The converging nozzle 46 includes converging walls 50 and the diverging nozzle 48 includes diverging walls 52. The narrowest point of the converging walls 50 are illustrated by arrows A. The narrowest point is referred to as the throat 53. In some embodiments as shown, the fuel inlets 42 are located at the throat 53 denoted by the arrows A. In accordance with well understood principles regarding a venturi, as air flows through the converging nozzle 46, the air will speed up thereby creating a lower pressure. This lower pressure will create a suction force to draw fuel from the fuel inlet 42 into the air stream. The fuel and air mixture will then flow through the diverging nozzle 48.

FIGS. 4-7 will now be described showing flaps (described as a first flap 54 and a second flap 56) having various dimensions, weights, and orientations according to various conditions shown and described with respect to the various FIGS. While the term "flap" is used, it is to be understood and any movable obstruction may be used.

Figure 4:
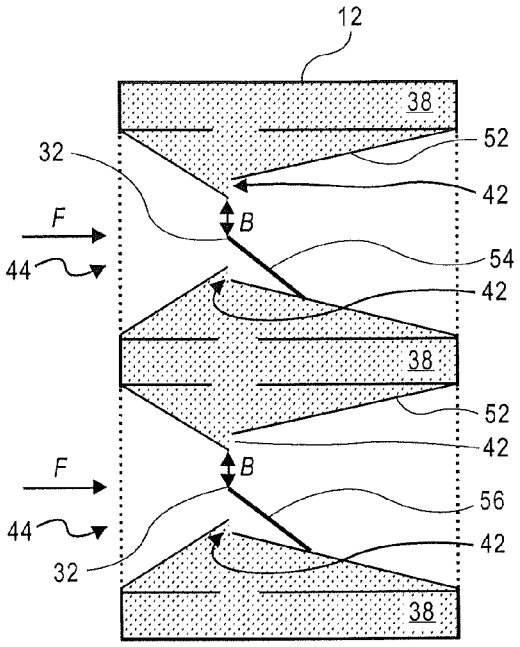
FIGS. 4-7 are partial cross-sectional views of manifolds showing venturi passageways of different dimensions and flaps being in different positions and weights.

In FIG. 4, the flaps 54 and 56 are shown in a closed position. The flaps 54 and 56 are weighted the same. Arrows F the note a direction of air flowing through the venturi 44. The amount of air flowing through the venturis does not have enough velocity to cause the flaps 54 and 56 to pivot on the pivot shafts 32. Gravity is keeping the flaps 54 and 56 in a closed position. In the closed position, fuel from the fuel inlets 42 located below the flaps 54 and 56 does not enter the air stream within the venturi. However, fuel does flow through the fuel inlet 42 located above the flaps 54 and 56. Thus, some fuel does enter the air stream along the upper diverging wall 52. Arrows B show the minimum size of the venturis 44 when the flaps 54 and 56 are closed.

It should be understood that the flaps or obstructions 36, 54, and 56 may be moved not only with air/fluid movement through the venturi but also by pressure. For example, in an initial condition, no fluid may be moving through a venturi but the flap 36, 54 and 56 may move to an open position as pressure increases due to the blower 22 starting from an off condition.

In embodiments where the flaps 54 and 56 are located in the throat 53 as shown, the actuation of the flaps 54 and 56 block not only airflow through the venturi 44 but fuel flow coming out of a fuel inlet 42 located in the throat 53 near the cutoff airflow. For example, in such an embodiment as shown in FIG. 4, flap 56 is in the closed position, thus blocking airflow from below the pivot shaft 32 and fuel flow from the fuel inlet 42 located below the pivot shaft 32 in the venturi 44 in which flap 56 is located. Thus, the flaps 54 and 56 can be used to block flows to both the airflow and a fuel flow.

Figure 5:
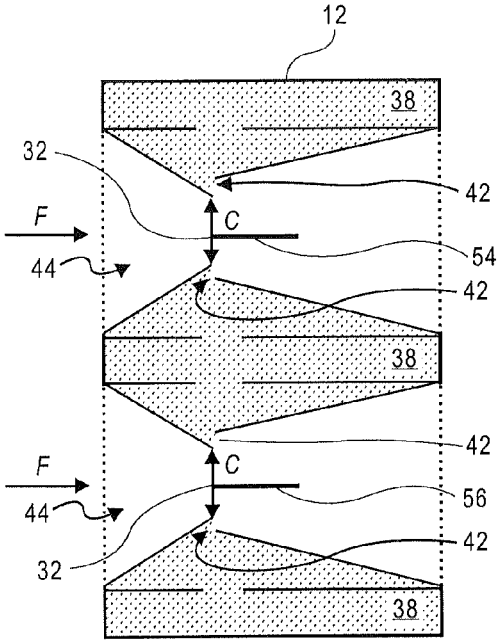

FIG. 5 shows a venturi manifold 12 similar to that shown in FIG. 4. Arrows F show the direction of airflow flowing into the venturis 44. In FIG. 4, the airflow is sufficient to cause the flaps 54 and 56 to pivot on the pivot shafts 32 to an open position. Now more air flows through the venturis 44 as the minimum size of the venturi as illustrated by arrows C is much larger. In addition, additional fuel is supplied from the fuel supply 38 as fuel is now flowing through all of the fuel inlets 42 both the fuel inlets 42 located above the flaps 54 and 56 and below the flaps 54 and 56.

Figure 6:
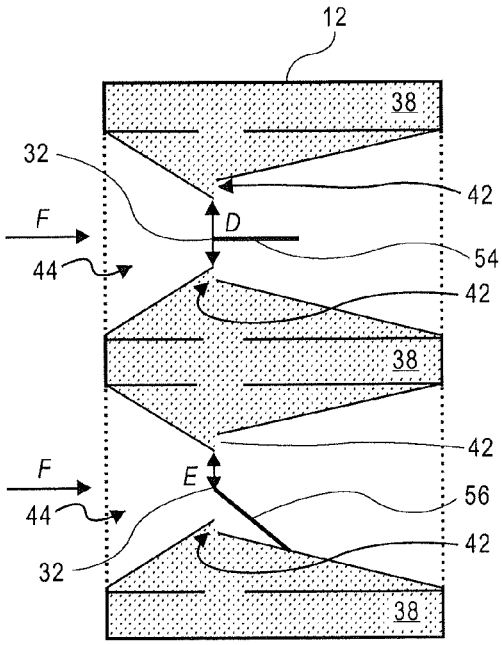

FIG. 6 illustrates a venturi manifold 12 where the flap 54 is lighter than the flap 56. In FIG. 6, air flows as denoted by direction arrow F into the venturi 44 with enough velocity to pivot flap 54 on the pivot shaft 32 to an open position but not with enough velocity to pivot flap 56 on the pivot shaft 32 to an open position. Under such conditions, the venturi 44 having flap 54 has a minimum cross-sectional area shown by arrow D to be larger than the minimum cross-section area as shown by arrow E of the venturi 44 equipped with flap 56. Under such conditions, the top of venturi 44 having a cross-section area denoted by arrow D has more air and more fuel as fuel is flowing from both fuel inlets 42 located above and below the flap 54 in the open position whereas the lower venturi 44 has less air and fuel only flowing through the upper fuel inlet 42 located above the flap 56. If the airflow was increased to overcome through the weight of the heavier flap 56, then the flap 56 would move to an open position and would be as described and shown with respect to FIG. 5.

Figure 7:
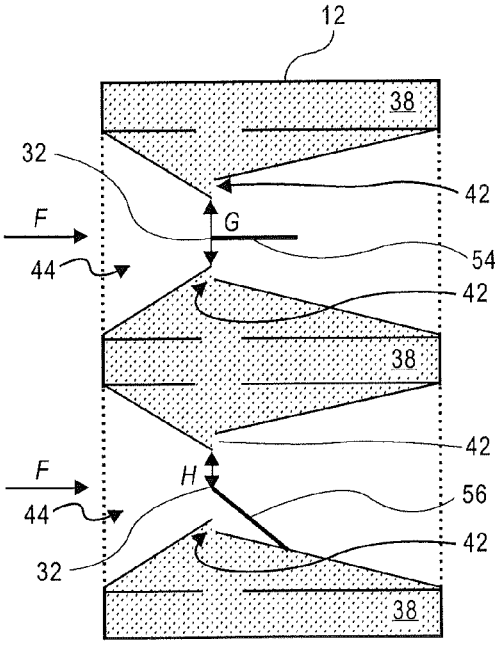

FIG. 7, illustrates yet another embodiment in accordance with the present disclosure. In FIG. 7, the two venturis 44 have different geometries. The lower venturi 44 has a larger minimum cross-sectional area than that minimum cross-sectional area of the upper venturi 44. These are illustrated by arrows G and H. The minimum cross-sectional areas of the various venturis 44 may be selected according to fuel and air needs for a specific system 10 in the embodiment shown in FIG. 7. The flaps 54 and 56 have different weights. As air flows into the venturis 44 as shown in the direction illustrated by arrows F, the flap 54 is lighter than the flap 56. The flap 54 will move from the closed position to an open position at a lower air velocity than the flap 56. Thus, under certain conditions, the flap 54 is in an open position and the flap 56 may be in a closed position. Fuel will flow through the fuel inlets 42 into the air stream from both above and below the flaps 54 and 56 depending upon whether the flaps 54 and 56 are open or closed as described above. As discussed above, if the airflow is increased, then both flaps 54 and 56 may move to the open position as shown in FIG. 5.

While the flaps 54 and 56 are shown in FIG. 7 and the other FIGS. to pivot on pivot shafts 32, the flaps, in other embodiments, may move from an open position to a closed position and vice versa in other ways besides pivoting. For example, the flaps 54 and 56 may slide between open and closed positions or move in other suitable ways.

The various arrows A, B, C, D, E, G, and H, the note minimum cross-sectional areas of the venturis 44 when flaps 54 and 56 are in open or closed positions. While the terms "open" and "closed" are used, it should be understood that "open" may also refer to a partially open position as well as a fully open position. The various geometries for the minimum cross-sectional area of the venturis 44 may be selected according to desired needs of fuel and air for the various combustion systems 10. In some embodiments, the flaps 36, 54, and 56 cut off about half of the airflow that can flow through a venturi 44 when the flaps 36, 54, and 56 are in the closed position. In other embodiments, the amount of airflow that may be blocked can be selected by one of ordinary skill in the art to satisfy a particular installation. Furthermore, various geometries and sizes of venturis 44 may be selected according to various needs by one of ordinary skill in the art after reviewing this disclosure. In some embodiments, air may flow through the venturi manifold 12 if all, some, or none of the flaps 54 and 56 are in an open position. In other embodiments, no air can flow through the venturi 44 if the flaps 54 and 56 are in a closed position.

In some embodiments, the venturi manifolds 12 may have two, three, four or more venturis 44. The venturis 44 may have the same or different sizes according to the needs of the various systems. The flaps 36, 54, and 56 may be weighted the same or different according to the needs of an individual system. In addition to having different weights, other ways of causing the flaps 36, 54, and 56 to open at different airflow conditions may be to use springs or friction devices to inhibit the ability of the flaps 36, 54, and 56 to open unless air velocity reaches a certain point. The flaps 36, 54, and 56 may also be operated by a controller and have an actuator to move the flaps 36, 54, and 56.

Certain embodiments, in accordance with the present disclosure, permit airflow through a combustion system 10 to be scaled along a much larger range then traditional systems. If only a small amount of air and fuel is required then all or only one of the flaps 36, 54, and 56 may close permitting only a small amount of air and fuel as needed to flow through the combustion system 10. If more air is desired more flaps 36, 54, or 56 may be moved to the open position thereby allowing an appropriate amount of air and also fuel to flow through the system 10.

The many features and advantages of the invention are apparent from the detailed specification, and thus, it is intended by the appended claims to cover all such features and advantages of the invention which fall within the true spirit and scope of the invention. Furthermore, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A mixing manifold comprising:

a body;

a first converging passageway in the body;

a first diverging passageway in the body in-line and in fluid communication with the first converging passageway to form a first venturi;

a first obstruction in a throat of the first venturi spaced from structure defining the first converging and diverging passageways, the first obstruction configured to move between two positions, a blocking position that blocks, at least in part, flow through the first venturi and an open position;

a second converging passageway in the body;

a second diverging passageway in the body in-line and in fluid communication with the second converging passageway to form a second venturi; and a second obstruction in the second venturi spaced from structure defining the second converging and diverging passageways, the second obstruction configured to move between two positions, a blocking position that blocks, at least in part, flow through the second venturi and an open position.

2. The mixing manifold of claim 1, wherein the first and second venturis, at their most convergent portion, have different cross-sectional areas.

3. The mixing manifold of claim 1, wherein the first and second obstructions are configured to move from the blocking to the open position when a fluid at the first venturi is at least one of; at a first velocity and at a first pressure and fluid at the second venturi is at a second velocity or second pressure.

4. The mixing manifold of claim 3, wherein the first and second velocities or pressures are not the same.

5. The mixing manifold of claim 1, wherein the obstructions are pivotally attached to the body.

6. The mixing manifold of claim 1, wherein the first and second obstructions are dimensioned to block about half of the first and second venturis when the first and second obstructions are in the blocking position.

7. The mixing manifold of claim 1, further comprising;

a third converging passageway in the body;

a third diverging passageway in the body in-line and in fluid communication with the third converging passageway to form a third venturi; and a third obstruction in the third venturi configured to move between two positions, a blocking position that blocks, at least in part, flow through the third venturi and an open position.

8. The mixing manifold of claim 7, further comprising:

a fourth converging passageway in the body;

a fourth diverging passageway in the body in-line and in fluid communication with the fourth converging passageway to form a fourth venturi; and a fourth obstruction in the fourth venturi configured to move between two positions, a blocking position that blocks, at least in part, flow through the fourth venturi and an open position.

9. The mixing manifold of claim 8, wherein the first, second, third, and fourth obstructions are configured to move from the blocking to the open position when a fluid is at the first venturi at a first velocity or first pressure, the second venturi at a second velocity or second pressure, the third venturi at a third velocity or third pressure, and the fourth venturi at a fourth velocity or fourth pressure.

10. The mixing manifold of claim 9, wherein the first, second, third, and fourth velocities and pressures are not the same.

11. The mixing manifold of claim 1, further comprising a fluid conduit having an opening near the most convergent portion of the first venturi providing fluid communication between the first venturi and a fuel reservoir.

12. A mixing manifold comprising:

a body;

a first converging passageway in the body;

a first diverging passageway in the body in-line and in fluid communication with the first converging passageway to form a first venturi;

a first obstruction in a throat of the first venturi configured to move between two positions, a blocking position that blocks, at least in part, flow through the first ventral and an open position;

a second converging passageway in the body;

a second diverging passageway in the body in-line and in fluid communication with the second converging passageway to form a second venturi; and a second obstruction in the second venturi configured to move between two positions, a blocking position that blocks, at least in part, flow through the second venturi and an open position, and wherein the first and second obstructions have different weights.

13. A mixing manifold comprising:

a body;

a first converging passageway in the body;

a first diverging passageway in the body in-line and in fluid communication with the first converging passageway to form a first venturi;

a first obstruction in a throat of the first venturi configured to move between two positions, a blocking position that blocks, at least in part, flow through the first venturi and an open position;

a second converging passageway in the body;

a second diverging passageway in the body in-line and in fluid communication with the second converging passageway venturi; and a second obstruction in the second venturi configured to move between two positions a blocking position that blocks, at least in part, flow through the second venturi and an open position, and wherein the obstructions are configured to be biased by gravity to the closed position.

14. A mixing manifold comprising:

a body;

a first converging passageway in the body;

a first diverging passageway in the body in-line and in fluid communication with the first converging passageway to form a first venturi;

a first obstruction in a throat of the first venturi configured to move between two positions, a blocking position that blocks, at least in part, flow through the first venturi and an open position;

a second converging passageway in the body;

a second diverging passageway in the body in-line and in fluid communication with the second converging passageway to form a second venturi;

a second obstruction in the second venturi configured to move between two positions, a blocking position that blocks, at least in part, flow through the second venturi and an open position;

a third converging passageway in the body;

a third diverging passageway in the body in-line and in fluid communication with the third converging passageway to form a third venture;

a third obstruction in the third venturi configured to move between two positions, a blocking position that blocks, at least in part, flow through the third venturi and an open position;

a fourth converging passageway in the body;

a fourth diverging passageway in the body in-line and in fluid communication with the fourth converging passageway to form a fourth venturi; and a fourth obstruction in the fourth venturi configured to move between two positions, a blocking position that blocks, at least in part, flow through the fourth venturi and an open position; and wherein the first, second, third, and fourth obstructions have different weights.

15. A method of providing fluid flow through a manifold comprising:

providing multiple venturi passageways in a body;

installing an obstruction in a throat of the venturi passageways wherein the obstruction is spaced away from structure that defines the venturi passageways;

configuring the obstruction to move between a blocking position and an open position.

16. The method of claim 15, wherein the each obstruction has a different weight.

17. The method of claim 15, further comprising configuring each obstruction in each venturi to move from the blocking position to the open position when fluid at each venturi is at a different velocity or pressure.

18. The method of claim 15, further comprising sizing the venturi passage ways to have different dimensions.

19. The method of claim 15, further comprising pivotally connecting the obstructions to the body.

20. A mixing manifold comprising:

a body;

a first converging passageway in the body;

a first diverging passageway in the body in-line and in fluid communication with the first converging passageway to form a first venturi;

a first means for obstructing located in a throat in the first venturi spaced from structure defining the fist converging and diverging passageways, the first obstruction configured to move between two positions, a blocking position that blocks, at least in part, flow through the first venturi and an open position;

a second converging passageway in the body;

a second diverging passageway in the body in-line and in fluid communication with the second converging passageway to form a second venturi; and a second means for obstructing in the second venturi spaced from structure defining the second converging and diverging passageways, the second obstruction configured to move between two positions, a blocking position that blocks, at least in part, flow through the second venturi and an open position.

* * * * *